US009590341B2

(12) United States Patent
Sunaga et al.

(10) Patent No.: US 9,590,341 B2
(45) Date of Patent: Mar. 7, 2017

(54) CONNECTOR TERMINAL AND METHOD FOR PRODUCING CONNECTOR TERMINAL

(71) Applicants: AUTONETWORKS TECHNOLOGIES, LTD, Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Takahiro Sunaga, Yokkaichi (JP); Yoshifumi Saka, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 14/655,233

(22) PCT Filed: Jul. 16, 2013

(86) PCT No.: PCT/JP2013/069265

§ 371 (c)(1),
(2) Date: Jun. 24, 2015

(87) PCT Pub. No.: WO2014/109084

PCT Pub. Date: Jul. 17, 2014

(65) Prior Publication Data

US 2015/0357737 A1 Dec. 10, 2015

(30) Foreign Application Priority Data

Jan. 10, 2013 (JP) ..... 2013-002294

(51) Int. Cl.

| | |
|---|---|
| ***H01R 13/02*** | (2006.01) |
| ***H01R 13/03*** | (2006.01) |
| ***C25D 7/00*** | (2006.01) |

(Continued)

(52) U.S. Cl.

CPC ..... *H01R 13/03* (2013.01); *C25D 3/46* (2013.01); *C25D 7/00* (2013.01); *H01R 43/16* (2013.01); *Y10T 428/12556* (2015.01)

(58) Field of Classification Search

CPC .... H01R 13/03; H01R 23/7073; H01R 43/16; H01R 43/24; H05K 3/308

(Continued)

(56) References Cited

U.S. PATENT DOCUMENTS 3,281,763 A * 10/1966 Crowley ..... H01R 13/02 439/872
5,498,166 A * 3/1996 Rothenberger ..... H01R 13/521 439/66

(Continued)

FOREIGN PATENT DOCUMENTS

JP H05-311492 A 11/1993
JP H09-249977 A 9/1997

(Continued)

OTHER PUBLICATIONS

Sep. 17, 2013 International Search Report issued in International Patent Application No. PCT/JP2013/069265.

*Primary Examiner* — Abdullah Riyami
*Assistant Examiner* — Vladimir Imas
(74) *Attorney, Agent, or Firm* — Oliff PLC

(57) ABSTRACT

It is aimed to provide a connector terminal including a silver layer on a surface of an electrical contact portion, having a reduced coefficient of friction of a surface and excellent in practicality and productivity and provide a method for producing such a connector terminal. A coating layer made of a silver layer and a film formed by bringing the silver layer into contact with a solution containing thiol and benzotriazole is formed on a contact portion of a connector terminal to be electrically brought into contact with another electrically conductive member. A solvent of this solution is preferably water and the thiol is preferably octadecanethiol.

8 Claims, 1 Drawing Sheet

(51) Int. Cl.
*C25D 3/46* (2006.01)
*H01R 43/16* (2006.01)

(58) Field of Classification Search
USPC ..... 439/886
See application file for complete search history.

(56) References Cited

U.S. PATENT DOCUMENTS

| | | | | |
|---|---|---|---|---|
| 6,071,141 | A * | 6/2000 | Semmeling | H01R 13/6275 439/353 |
| 6,180,288 | B1 * | 1/2001 | Everhart | G01N 33/54373 264/1.1 |
| 6,395,454 | B1 * | 5/2002 | Piscevic | B82Y 10/00 257/E21.259 |
| 6,627,329 | B1 | 9/2003 | Shintani | |
| 7,104,850 | B2 * | 9/2006 | Suzuki | B82Y 30/00 439/886 |
| 7,154,657 | B2 * | 12/2006 | Poll | E06B 3/66 252/583 |
| 7,470,465 | B2 | 12/2008 | Ohwaki et al. | |
| 8,002,595 | B2 | 8/2011 | Kobayashi | |
| 8,216,645 | B2 * | 7/2012 | Abys | C23C 22/02 427/337 |
| 2009/0121192 | A1 * | 5/2009 | Abys | C23C 22/02 252/392 |

FOREIGN PATENT DOCUMENTS

| | | | |
|---|---|---|---|
| JP | 2000-015743 | A | 1/2000 |
| JP | 2000-282033 | A | 10/2000 |
| JP | 2008-192610 | A | 8/2008 |
| JP | 4348288 | B2 | 10/2009 |

* cited by examiner

CONNECTOR TERMINAL AND METHOD FOR PRODUCING CONNECTOR TERMINAL

TECHNICAL FIELD

The present invention relates to a connector terminal and a method for producing the same and more particularly to a connector terminal including a silver layer on a surface and a method for producing the same.

BACKGROUND ART

Conventionally, a connector terminal formed by applying metal plating to a surface of a base material such as copper or copper alloy has been generally used as the one for connecting an electrical component or the like of an automotive vehicle. Tin is most general as such plating metal, but silver is used particularly for terminals for high current in some cases since it provides relatively low contact resistance and good connection reliability.

However, silver is soft metal and aggregation on a surface easily occurs. This causes problems of an increase in coefficient of friction at a contact portion and a reduction in wear resistance and an increase in terminal insertion force associated with that in a silver-plated terminal.

To reduce the coefficient of friction at the terminal contact portion, it is known to form a layer containing organic components on the contact portion and provide a lubrication effect. For example, it is disclosed in patent literature 1 to form an organic substance bonding layer made of an organic compound containing a thiol group on a surface of a plating layer of gold or the like and form a lubricant layer made of oil on the former layer. Further, it is disclosed in patent literature 2 to form a coating film having a thickness of 0.2 to 0.5 μm, in which fluororesin fine particles and fluorine-based oil are mixed, on a substrate surface. In application, fluororesin fine particles and fluorine-based oil are dispersed and diluted in a fluorine-based solvent.

CITATION LIST

Patent Literature

Patent literature 1: Japanese Unexamined Patent Publication No. 2000-15743

Patent literature 2: Publication of Japanese Patent No. 4348288

SUMMARY

Technical Problem

In the configuration of patent literature 1, an oil layer having a thickness of 100 to 400 μm is necessary with reference to an embodiment. If such a large amount of oil is used, the terminal contact portion becomes sticky and practicality is low. Further, since a process of forming the organic substance bonding layer and a process of forming the lubricant layer have to be successively and separately performed, a production process becomes cumbersome and productivity is reduced.

Also in the configuration of patent literature 2, the coating film containing fluorine-based oil is applied to have a submicron thickness, wherefore the terminal contact portion becomes sticky to a certain extent. Further, by using the fluorine-based solvent and fluorine-based oil in a production process, the use and disposal thereof take time and labor, thereby causing a reduction in the productivity of the connector terminal.

A problem sought to be solved by preferred embodiments is to provide a connector terminal including a silver layer on a surface of an electrical contact portion, having a reduced coefficient of friction of a surface and excellent in practicality and productivity and a method for producing such a connector terminal.

Solution to Problem

To solve the above problem, a connector terminal according to preferred embodiments includes a coating layer formed at a contact portion to be electrically brought into contact with another electrically conductive member and including a silver layer and a film formed by bringing the silver layer into contact with a solution containing thiol and benzotriazole.

Here, a solvent of the solution containing the thiol and the benzotriazole is preferably water.

Further, the thiol is preferably octadecanethiol.

A connector terminal production method according to the preferred embodiments is such that a film is formed on a surface of a silver layer by bringing the silver layer into contact with a solution containing thiol and benzotriazole after the silver layer is formed on an outermost surface of a contact portion to be electrically brought into contact with another electrically conductive member.

Here, a solvent of the solution containing the thiol and the benzotriazole is preferably water.

Further, the thiol is preferably octadecanethiol.

Effects

According to the connector terminal of preferred embodiments, the film formed by contact with the solution containing thiol and benzotriazole reduces a coefficient of friction of the silver layer surface. The process is particularly efficient because a large amount of organic molecules do not remain on the silver surface, which would have the adverse effect of making the terminal contact portion sticky. Further, productivity is excellent because the connector terminal according to preferred embodiments can be produced only by dissolving thiol and benzotriazole in a solvent and bringing this solution into contact with a terminal material.

Here, if the solvent of the solution containing the thiol and the benzotriazole is water, the solution can be easily handled and discarded. Thus, the productivity of the connector terminal is further improved. Further, the use of a solvent in the production process, which has a negative impact on the environment, can be avoided.

Further, if the thiol is octadecanethiol, a high lubrication effect can be provided to the contact portion.

According to the connector terminal production method disclosed in preferred embodiments, a connector terminal having a low coefficient of friction and excellent in practicality can be produced with high productivity.

PREFERRED EMBODIMENTS

Hereinafter, a preferred embodiment is described in detail using the drawings.

Figure 1:
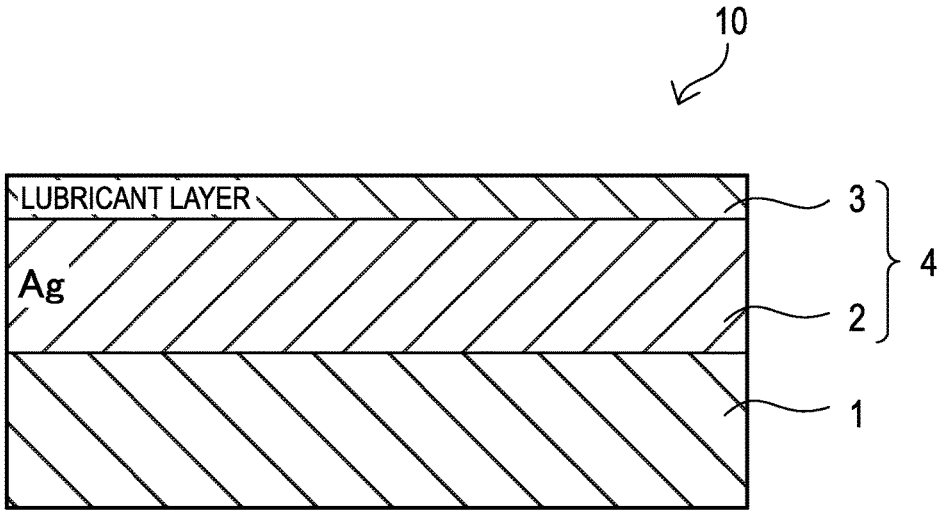
FIG. 1 is a schematic section showing a lamination structure at a contact portion of a connector terminal according to one embodiment.

In a connector terminal, at least a contact portion to be electrically brought into contact with another electrically conductive member is made of a connector terminal material 10 shown in FIG. 1. The connector terminal material 10 includes a coating layer 4 composed of a sliver layer 2 and a lubricant layer 3 formed on the silver layer 2 on a surface of a base material 1.

The base material 1 serves as a substrate of the connector terminal and may be made of any metal material, but the base material of the connector terminal is generally copper or copper alloy, for example. Further, an intermediate layer may be formed below the silver layer 2 on the surface of the base material 1 as appropriate such as for the purpose of enhancing adhesion between the silver layer 2 and the base material 1 and providing heat resistance. A nickel layer, for example, can be illustrated as such an intermediate layer and functions to obstruct the diffusion of copper atoms from the base material 1 into the silver layer 2 when the base material 1 is made of copper or copper alloy.

The silver layer 2 may be a hard silver layer or a soft silver layer. A soft silver layer having a large coefficient of friction reducing effect, low resistance and high heat resistance reliability is preferable. Because silver has a relatively low resistivity among various metals and surface oxidation does not progress very much, a low contact resistance value is indicated on the surface. A thickness of the silver layer 2 is preferably in a range of 1 to 10 μm. If the silver layer 2 is thinner than this range, the contact resistance reducing effect is small. On the other hand, if the silver layer 2 is thicker than this range, it is difficult to effectively reduce the coefficient of friction of the surface due to the softness of silver even if the lubrication layer 3 is formed on the surface. The silver layer 2 may be formed by any method, but is preferably formed by electroplating in terms of productivity and suppressing production cost.

The lubricant layer 3 is formed by bringing the silver layer 2 into contact with a solution containing thiol and benzotriazole. The lubricant layer 3 functions to reduce a coefficient of friction of the surface of the silver layer 2. By reducing the coefficient of friction of the surface of the terminal contact portion, wear resistance of the terminal contact portion is improved and a force (insertion force) required when the terminal is inserted and withdrawn is also reduced.

By forming the lubricant layer 3 on the surface of the silver layer 2, the coefficient of friction of the surface is reduced even if a general oil component is not used as a lubricant. Thus, there is no stickiness as in the case of using oil and the connector terminal is excellent in practicality.

To bring the silver layer 2 into contact with the solution containing thiol and benzotriazole can be accomplished by immersing the silver layer 2 in such a solution or by dripping or other application of such a solution on the surface of the silver layer 2. The solution may be brought into contact with the silver layer 2 in a method other than immersion, dripping or application, but it is preferable to immerse the silver layer 2 in the solution and leave it for a fixed time in order to reliably form the lubricant layer 3.

Any solvent may be used to prepare the solution if it can dissolve thiol and benzotriazole, but the use of water is preferable. This is because water easily evaporates into the atmosphere and is free from such an undesirable situation where the solvent remains on the terminal surface to reduce the handling of the connector terminal such as in the case of using an organic solvent. Further, by using water as the solvent, it becomes easier to handle and discard the solvent in the production process and waste liquid does not adversely affect an environment.

Thiol used in the lubricant layer 3 preferably has such a large molecular weight as to be able to sufficiently remain stable as the lubricant layer 3 on the silver surface and has such a small molecular weight as to be able to be dissolved in the solvent with sufficient solubility. In the case of linear alkanethiol, a carbon number is preferably about 5 to 30, more preferably about 10 to 25. For example, octadecanethiol (carbon number: 18) is dissolvable in solvents such as water and alcohols and remains together with benzotriazole on the silver surface even after the silver layer 2 is brought into contact with a mixed solution with benzotriazole and dried, with the result that a high coefficient of friction reducing action is exhibited. A coefficient of friction of the surface of the silver layer 2 in a state where the lubricant layer 3 is not formed on the surface is about 0.6 to 1.0, but the coefficient of friction is a small value of not larger than 0.3 if the lubricant layer 3 using octadecanethiol and benzotriazole is formed on the surface.

Figure 2:
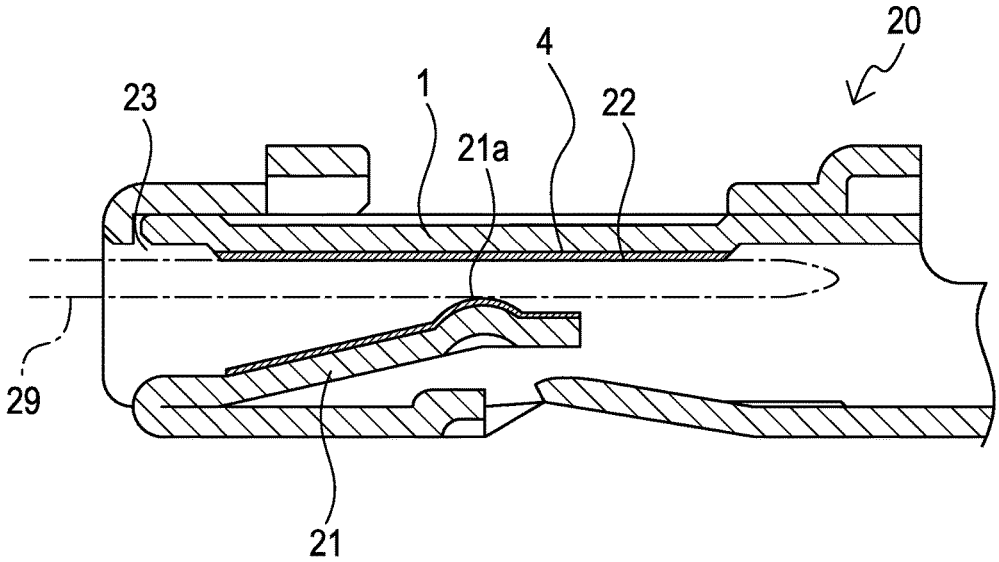
FIG. 2 is a diagram showing the configuration of the connector terminal according to the one embodiment.

The connector terminal according to preferred embodiments may have any shape. The configuration of a female connector terminal 20 is shown as an example in FIG. 2. The female connector terminal 20 is shaped similarly to known female connector terminals. Specifically, a tightly holding portion 23 of the female connector terminal 20 is formed into a rectangular tubular shape with an open front side and a male terminal 29 as a mating connection member is inserted into the tightly holding portion 23. A resilient contact piece 21 folded inwardly to extend backward is formed at an inner side of the bottom surface of the tightly holding portion 23. The resilient contact piece 21 comes into contact with the male terminal 29 at an embossed portion 21*a* projecting toward the inside of the tightly holding portion 23 and applies an upward acting force to the male terminal 29. A surface of a ceiling portion of the tightly holding portion 23 facing the resilient contact piece 21 serves as an inner facing contact surface 22 and the male terminal 29 is pressed against the inner facing contact surface 22 by the resilient contact piece 21, thereby being tightly held in the tightly holding portion 23.

Out of the base material 1 forming the connector terminal 20, a coating layer 3 composed of a silver layer 2 and a lubricant layer 3 is formed on a surface of the resilient contact piece 21 and the inner facing contact surface 22 exposed to the inside of the tightly holding portion 23. In this way, a low coefficient of friction is realized at contact portions of the resilient contact piece 21 and the inner facing contact surface 22 with the male terminal 29. Here, it is sufficient to form the coating layer 4 only on the embossed portion 21*a* of the resilient contact piece 21 without forming the coating layer 4 over the entire surface of the resilient contact piece 21. Conversely, the coating layer 4 may be formed over a wider area or may cover the entire surface of the base material 1 constituting the connector terminal 20. Further, the coating layer 4 may also be formed on a surface of the male terminal 29.

A sequence of forming the connector terminal may be such that the coating layer 4 is formed after a terminal shape such as that of the above female connector terminal is formed using the base material 1 by press-working or the like or may be such that the terminal shape is formed after the coating layer 4 is formed on the base material 1 in the form of a flat plate. Alternatively, the terminal shape may be formed after the silver layer 2 is formed on the surface of the base material 1 in the form of a flat plate and, then, the lubricant layer 3 may be formed by contact with the solution. If it is necessary to cautiously prevent the peeling of the lubricant layer 3 in a machining process, at least the formation of the lubricant layer 3 may be performed after the terminal shape is formed.

EXAMPLES

The preferred embodiment is described in detail below using the following examples.

Example 1

A soft silver layer having a thickness of 5 μm was formed on a surface of a plate-like copper alloy base material by electroplating. This silver-plated plate was immersed at 52° in a mixed solution ("CE9500W" produced by Chemical Denshi Co., Ltd.) of octadecanethiol (C18SH) and benzotriazole (BTA) for 1 min. and taken out, thereafter, naturally dried.

Comparative Example 1

A silver plated-plate produced as in Example 1 was immersed at 52° in a benzotriazole solution having a concentration of 0.025% for 1 min. and taken out, thereafter, naturally dried.

Comparative Example 2

A silver plated-plate produced as in Example 1 was immersed at 52° in an octadecanethiol solution having a concentration of 1 mM for 1 min. and taken out, thereafter, naturally dried.

[Test Method]

(Evaluation of Coefficient of Friction)

A dynamic coefficient of friction was evaluated for sample pieces according to Example 1 and Comparative Examples 1, 2 as an index of a terminal insertion force. That is, a sample piece in the form of a flat plate and an embossed sample piece having a radius of 3 mm were held in contact in a vertical direction, the embossed plated member was pulled at a speed of 10 mm/min in a horizontal direction while a load of 5 N was applied in the vertical direction using a piezo actuator, and a (dynamic) frictional force was measured using a load cell. A coefficient of friction was obtained by dividing the frictional force by the load. Five independent measurements were conducted for each sample piece.

(Surface Analysis by TOF-SIMS)

Chemical species present on a surface were analyzed for the sample pieces according to Example 1 and Comparative Example 2 using time-of-flight secondary ion mass spectrometry (TOF-SIMS).

[Test Result and Considerations]

Table 1 shows a measurement result on the coefficient of friction for each sample piece.

TABLE 1

| | Example 1 (C18SH + BTA) | C. Example 1 (BTA) | C. Example 2 (C18SH) |
|---|---|---|---|
| Coefficient of Friction | 0.2 | 0.3 | 0.3 to 0.6 |

According to Table 1, a low coefficient of friction was observed for the sample piece according to Example 1 in which the lubricant layer was formed by immersion in the mixed solution of octadecanethiol and benzotriazole as compared with the case of immersion in the solution containing only benzotriazole (Comparative Example 1) or only octadecanethiol (Comparative Example 2). That is, the coefficient of friction of the silver layer surface is effectively reduced by the coexistence of octadecanethiol and benzotriazole in the solution for immersion. Further, the coefficient of friction largely varies in the case of containing only octadecanethiol in Comparative Example 2, whereas a low coefficient of friction is stably obtained in the sample piece according to Example 1.

Next, the presence or absence of observed main fragment components for the observation result by TOF-SIMS is compiled in Table 2. A case where the fragment components were observed is shown by ○ and a case where no fragment component was observed is shown by x.

TABLE 2

| Ion Species (m/Z) | By-Product | Example 1 (C18SH + BTA) | C. Example 2 (C18SH) |
|---|---|---|---|
| $Ag^+$ (107, 109) | Silver Atoms | ○ | ○ |
| $CN^-$ (26), $C_6H_4N^-$ (90), $C_6H_4N_3^-$ (118) | Benzotriazole | ○ | X |
| $C_{18}H_{37}S^-$ (285) | Thiol molecules | ○ | ○ |
| $C_{18}H_{37}SAg_2^+$ (499 to 505) | Silver Thiolate | X | ○ |

In the sample piece according to Example 1, components derived from benzotriazole and those derived from thiol molecules are observed and the both components are known to be contained in the lubricant layer formed on the sample piece surface. That is, a reduction of the coefficient of friction as described above is thought to be achieved by the cooperation of the benzotriazole-derived components and thiol-derived components.

The thiol molecules on the silver surface as on the sample piece according to Comparative Example 2 are widely known to have a silver thiolate structure in which S—H bonds are dissociated and S—Ag bonds are formed and to form a densely oriented self-assembled monolayer (SAM). In correspondence with the formation of silver thiolate, fragments containing $SAg_2$ are observed by TOF-SIMS for the sample piece 2. Contrary to this, such fragments are not observed in Example 1 and it is understood that silver thiolate is not formed or the amount of silver thiolate is a negligible level. That is, in the sample piece of Example 1, thiol components are thought to coexist with benzotriazole components in a chemical state different from that in Comparative Example 2 and contribute to a reduction of the friction coefficient.

Although the embodiment of the present invention has been described in detail above, the present invention is not limited to the above embodiment at all and various changes can be made without departing from the gist of the present invention.

The invention claimed is:

1. A connector terminal comprising:

a contact portion configured to be electrically brought into contact with another electrically conductive member, wherein the contact portion is covered with a coating layer that includes a silver layer and a film formed by bringing the silver layer into contact with a solution containing a thiol compound and benzotriazole, and the formation of the film occurs substantially without the formation of silver thiolate.

2. A connector terminal according to claim 1, wherein a solvent of the solution containing the thiol compound and the benzotriazole is water.

3. A connector terminal according to claim 1, wherein the thiol compound is octadecanethiol.

4. A method for manufacturing an electrical terminal configured to be brought into contact with with another electrical member, the method comprising:

forming a silver layer on an outermost surface of a contact portion of the connector terminal, the outermost surface being configured to be electrically in contact with the other electrical member;

forming a film on the surface of the silver layer by bringing the silver layer into contact with a solution containing a thiol compound and benzotriazole, wherein the formation of the film occurs substantially without the formation of sifter thiolate.

5. A method for manufacturing an electrical terminal according to claim 4, wherein a solvent of the solution containing the thiol compound and the benzotriazole is water.

6. A method for manufacturing an electrical terminal according to claim 5, wherein the thiol compound is octadecanethiol.

7. A method for manufacturing an electrical terminal according to claim 4, wherein the thiol compound is octadecanethiol.

8. A connector terminal according to claim 1, wherein the thiol compound and the benzotriazole coexist in the solution as separate compounds.

* * * * *